US009234425B2

(12) United States Patent
Looney

(10) Patent No.: US 9,234,425 B2
(45) Date of Patent: Jan. 12, 2016

(54) SYSTEM AND METHOD FOR ENABLING MACHINE MOVEMENT

(71) Applicant: Caterpillar Global Mining America LLC, Houston, PA (US)

(72) Inventor: Jeffrey D. Looney, Christiansburg, VA (US)

(73) Assignee: Caterpillar Global Mining America LLC, Houston, PA (US)

( * ) Notice: Subject to any disclaimer, the term of this patent is extended or adjusted under 35 U.S.C. 154(b) by 11 days.

(21) Appl. No.: 13/915,741

(22) Filed: Jun. 12, 2013

(65) Prior Publication Data

US 2014/0369769 A1 Dec. 18, 2014

(51) Int. Cl.

| | |
|---|---|
| ***E21D 23/12*** | (2006.01) |
| ***E21D 23/00*** | (2006.01) |
| ***E21D 23/16*** | (2006.01) |
| ***E21D 20/00*** | (2006.01) |
| ***E21D 23/26*** | (2006.01) |

(52) U.S. Cl.

CPC ..... *E21D 23/16* (2013.01); *E21D 20/003* (2013.01); *E21D 23/0086* (2013.01); *E21D 23/26* (2013.01)

(58) Field of Classification Search

CPC . E21D 23/0454; E21D 23/0034; E21D 23/16; E21D 23/26

USPC ..... 405/288, 290, 291, 299, 302

See application file for complete search history.

(56) References Cited

U.S. PATENT DOCUMENTS

| | | | | |
|---|---|---|---|---|
| 3,964,265 | A | 6/1976 | Jamison | |
| 4,491,441 | A * | 1/1985 | Freeman et al. | 405/294 |
| 4,595,316 | A | 6/1986 | Tinnel | |

* cited by examiner

*Primary Examiner* — Tara M. Pinnock

(57) ABSTRACT

A system for enabling movement of a machine is provided. The system includes a support member provided on the machine. The support member is configured to be in a raised position or a lowered position relative to a frame of the machine. The system also includes an actuation module configured to selectively enable the movement of the machine. The system further includes an enabler valve coupled to the actuation module and the support member. The enabler valve is configured to selectively send a pilot signal to the actuation module based on the position of the support member.

20 Claims, 4 Drawing Sheets

SYSTEM AND METHOD FOR ENABLING MACHINE MOVEMENT

TECHNICAL FIELD

The present disclosure relates to a system and method for enabling movement of a machine, and more specifically for enabling the movement of the machine based on a position of a support member of the machine.

BACKGROUND

A mining machine includes an Automatic Temporary Roof Support (ATRS) for supporting roof of a mine during roof bolting and/or other mining operations. In order to support the roof of the mine, the ATRS is raised using adequate pressure and then allowed to rest against the roof of the mine.

Current systems on the mining machine allow movement of the mining machine irrespective of a position of the ATRS. This may be undesirable as it may lead to damage of the machine as well as structural damage to the roof of the mine in some cases.

U.S. Pat. No. 4,595,316 discloses a lightweight jack for supporting a mine roof until permanent supports are in place. The jack is carried by a roof bolter or similar mining equipment on an end of a support arm. A hinge box is mounted on a sidewall of the roof bolter and one end of the arm is hingedly received therein. A support plate extends from the sidewall outwardly below the arm.

SUMMARY OF THE DISCLOSURE

In one aspect of the present disclosure, a system for enabling movement of a machine is provided. The system includes a support member provided on the machine. The support member is configured to be in a raised position or a lowered position relative to a frame of the machine. The system also includes an actuation module configured to selectively enable the movement of the machine. The system further includes an enabler valve coupled to the actuation module and the support member. The enabler valve is configured to selectively send a pilot signal to the actuation module based on the position of the support member.

In another aspect, a method for enabling movement of a machine is provided. The method actuates an enabler valve coupled to an actuation module and a support member of the machine. The actuation is based on a position of the support member. The method sends a pilot signal from the enabler valve to the actuation module based on the actuation. The method enables, selectively, the movement of the machine based on the pilot signal.

In yet another aspect, a machine is provided. The machine includes a power source, a frame and a grounding engaging member. The machine includes a support member configured to be in a raised position or a lowered position relative to the frame of the machine. The machine includes an actuation module configured to selectively enable movement of the machine. The machine also includes an enabler valve coupled to the actuation module and the support member. The enabler valve is configured to selectively send a pilot signal to the actuation module based on the position of the support member. The machine further includes a propulsion module coupled to the actuation module and the ground engaging member. The propulsion module is configured to move the machine based on the enablement of the actuation module and a user command.

Other features and aspects of this disclosure will be apparent from the following description and the accompanying drawings.

DETAILED DESCRIPTION

Figure 1:
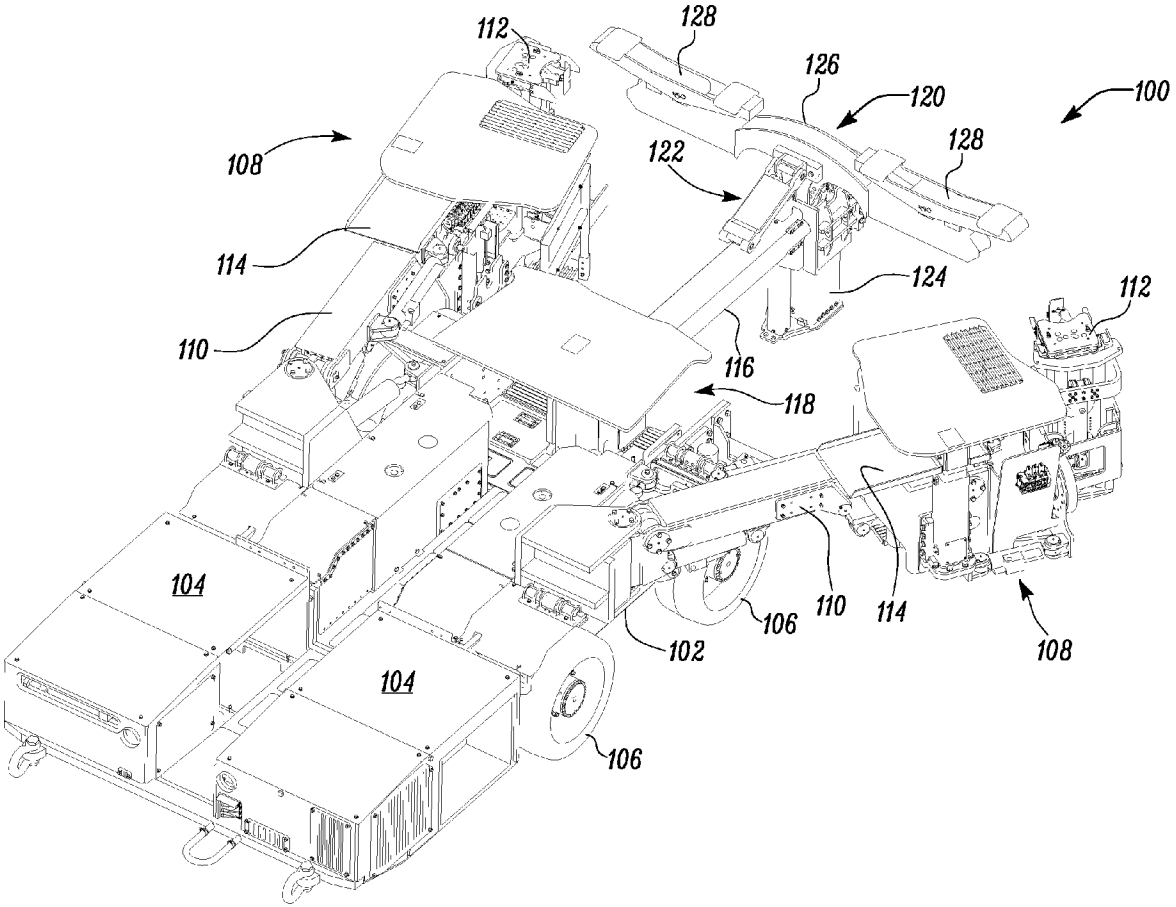
FIG. 1 is a perspective view of an exemplary machine having a support member, according to one embodiment of the present disclosure.

Wherever possible, the same reference numbers will be used throughout the drawings to refer to the same or the like parts. Referring to FIG. 1, an exemplary machine 100 is illustrated. More specifically, the machine 100 is a roof bolter. The machine 100 may be configured for supporting a section of roof of a mine and/or a tunnel during a roof bolting operation. The machine 100 may also be configured for performing the roof bolting operation using suitable rock drilling and bolting tools. It should be noted that the machine 100 may include any other machine having an implement capable of vertical movement with respect to the machine. For example, the machine 100 may embody, a mining machine, a truck mounted crane, a cherry picker, an elevated work platform and the like.

The machine 100 may include a frame 102 and/or a chassis 102. An enclosure 104 may be provided on the frame 102. The enclosure 104 may house a power source (not shown). The power source may be any conventional or non-conventional power source including, but not limited to, an internal combustion engine, power storage devices like batteries, electric motor and the like. The power source may be configured to provide power to the machine 100 for mobility and/or other operational needs. The enclosure 104 may also house various other components required for operational control of the machine 100 including, but not limited to, electrical and/or electronic components, hydraulic and/or pneumatic components and the like. Further, ground engaging members 106 such as wheels or tracks may be provided on the machine 100 for the purpose of mobility. A drivetrain (not shown) may be coupled to the power source and the ground engaging members 106. The drivetrain may include any one or a combination of, but not limited to, gearing, differentials, drive shafts and hydraulic and/or pneumatic circuits including valves, lines, distribution manifolds and the like. The drivetrain may be configured to transmit power from the power source to the ground engaging members 106.

The machine 100 may be provided with a drill boom assembly 108. The drill boom assembly 108 may be pivotally coupled to the frame 102 of the machine 100. The drill boom assembly 108 may include an arm 110 in order to pivotally couple the drill boom assembly 108 to the frame 102 of the machine 100. The drill boom assembly 108 may include a drill assembly 112. The drill assembly 112 may be configured to perform the rock bolting operation using suitable rock drilling and bolting tools. The drill boom assembly 108 may also include an operator platform 114. The operator platform 114 may be provided with various controls which may be used by an operator to control the drill boom assembly 108 and/or the machine 100.

It should be noted that the drill boom assembly 108 may be replaced by any other implement such as, for example, a bucket, as per operational requirements. Further, a horizontal boom 116 may be provided on the machine 100. A first end 118 of the horizontal boom 116 may be pivotally coupled to the frame 102 of the machine 100. A support member, hereinafter referred to as an Automatic Temporary Roof Support (ATRS) 120, may be provided on a second end 122 of the horizontal boom 116. The horizontal boom 116 may be configured as a telescopic boom having an extendable length in order to allow positioning of the ATRS 120 at a required location and distance with respect to the frame 102 of the machine 100, within the mine.

The ATRS 120 may include a vertical boom 124 coupled to a horizontal beam 126 provided with support pads 128. The vertical boom 124 may be configured as a telescopic boom having an extendable length in order to raise or lower the horizontal beam 126 with respect to the machine 100. When the ATRS 120 may be in the raised position, the support pads 128 may be configured to rest against a section of the roof of the mine and provide support to that particular section of the roof.

Figure 2:
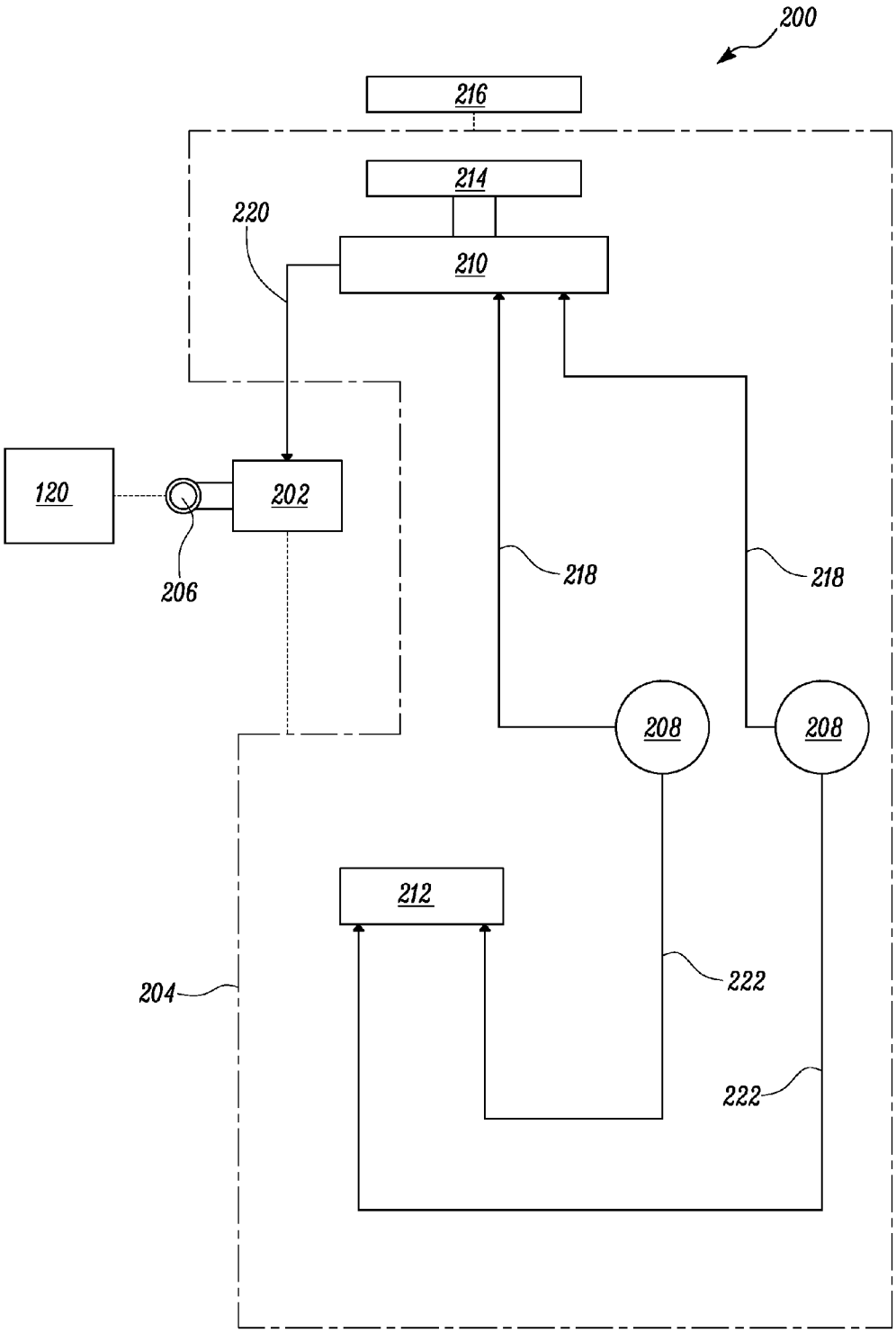
FIG. 2 is a flow diagram of a system for disabling a movement of the machine shown in FIG. 1 based on a position of the support member.
Figure 3:
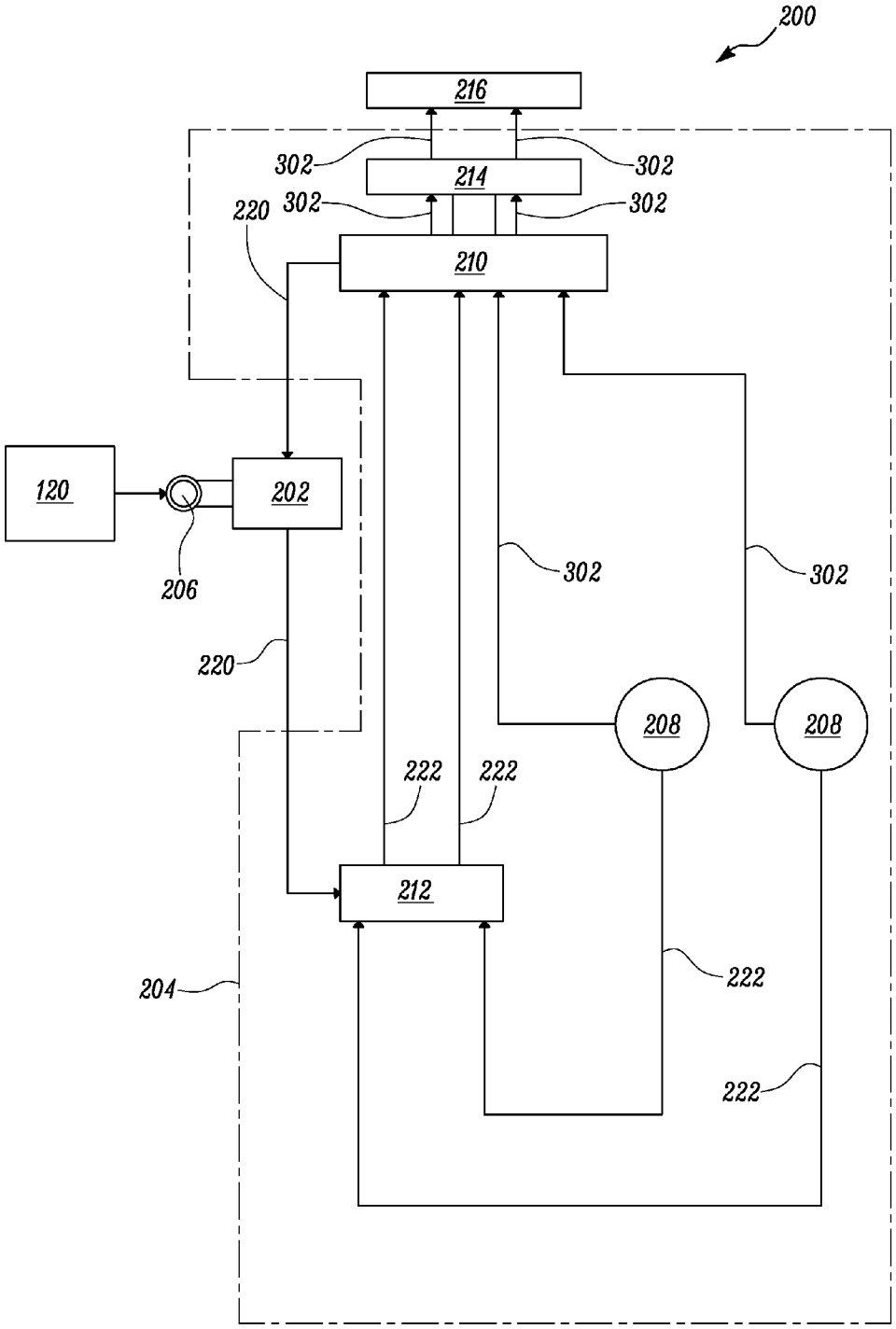
FIG. 3 is another flow diagram of the system for enabling the movement of the machine shown in FIG. 1 based on the position of the support member.

The present disclosure relates to a system 200 for enabling movement of the machine 100 based on the position of the ATRS 120 with respect to the machine 100. The system 200 may be a hydraulic and/or a pneumatic system. In the accompanying figures, dashed lines are indicative of mechanical connections between components of the system 200. The arrows shown in FIG. 2 and FIG. 3 are indicative of signal flow in the system 200. Referring to FIG. 2, the system 200 may include an enabler valve 202. The enabler valve 202 may be a 3-way, 2-position mechanical valve. The enabler valve 202 may be fluidly coupled to an actuation module 204. The enabler valve 202 may also be selectively mechanically coupled to the ATRS 120.

In one embodiment, the enabler valve 202 may be provided with a cam 206. More specifically, the cam 206 may be coupled to a spool (not shown) of the enabler valve 202. The cam 206 may be configured to selectively actuate the enabler valve 202 based on a position of the cam 206. The enabler valve 202 may be positioned on the horizontal boom 116 and in close proximity to the ATRS 120. More specifically, the enabler valve 202 may be positioned in a manner such that a portion of the ATRS 120 may be configured to come in contact with the cam 206 during the lowered position of the ATRS 120, thereby coupling the enabler valve 202 to the ATRS 120.

Other configurations of the cam 206 and the ATRS 120 may also be possible. In one embodiment, a protruding member such as a bar or a rod may be provided on the ATRS 120. When the ATRS 120 is in the lowered position, the protruding member may make contact with the cam 206 of the enabler valve 202. In another embodiment, the enabler valve 202 may be positioned on the horizontal boom 116 and approximately below the ATRS 120 such that the ATRS 120 may come in contact with the cam 206 of the enabler valve 202 during the lowered position of the ATRS 120. Contact between the ATRS 120 and the cam 206 may cause the position of the cam 206 to shift. Based on the shifting of the position of the cam 206, the spool may move causing the actuation of the enabler valve 202.

The actuation module 204 may include one or more pumps 208. The pumps 208 may be any one or a combination of pumps known in the art, for example, a rotary pump, a reciprocating pump and so on. The actuation module 204 may further include a first valve 210 and a second valve 212. The first valve 210 may be a 4-way, 3-position mechanical valve. The first valve 210 may be fluidly coupled to the enabler valve 202, the pump 208 and the second valve 212. The second valve 212 may be a 4-way, 2-position mechanical valve.

Further, the actuation module 204 may include a third valve 214. The third valve 214 may be mechanically and fluidly coupled to the first valve 210. Moreover, in one embodiment, the third valve 214 may be a mechanically operated valve. The third valve 214 may be configured to be in a locked state and a closed position initially when the ATRS 120 is in the raised position. One of ordinary skill in the art will appreciate that due to the locked state of the third valve 214, the third valve 214 may not be operable even on receiving a user command to move the machine.

The actuation module 204 may be configured to enable the movement of the machine 100 based on the position of the ATRS 120. Accordingly, the actuation module 204 may be coupled to a propulsion module 216. The propulsion module 216 may include hydraulic and/or pneumatic circuitry having valves, lines, motors, distribution manifolds and other hydraulic and/or pneumatic components. The propulsion module 216 may be coupled to the ground engaging members 106. The propulsion module 216 may be configured to provide power to the ground engaging members 106 to move the machine 100. More specifically, the propulsion module 216 may be configured to move the machine 100 based on the enablement of the actuation module 204 and the user command.

Initially, the pumps 208 may be configured to send pressure signals 218 to the first valve 210. It should be noted that initially the pumps 208 may operate at a partial capacity. Hence, the pressure signals 218 may have a substantially low pressure. The first valve 210 may be in a closed position initially and may accordingly be configured to block the pressure signals 218 from reaching the third valve 214. Further, due to the mechanical coupling between the third valve 214 and the first valve 210, the third valve 214 may be in the locked state. In one embodiment, the first valve 210 may be configured to utilize at least a part of the pressure signals 218 as a pilot signal 220. The first valve 210 may be configured to send the pilot signal 220 to the enabler valve 202. Initially, the enabler valve 202 may be in a closed position.

Additionally, the pumps 208 may also be configured to send load sense signals 222 to the second valve 212. The second valve 212 may initially be in a closed position. It should be noted that the pumps 208 may be configured to provide signals to other modules or components present on the machine 100 as per system design and requirements. More specifically, in the present disclosure, the enabler valve 202 may be configured to receive the pilot signal 220 from the first valve 210. The enabler valve 202 may be configured to send the pilot signal 220 to the second valve 212 based on the position of the ATRS 120, thereby selectively enabling the actuation module 204.

The working of the actuation module 204 in relation with the position of the ATRS 120 will now be described in detail with reference to FIGS. 2 and 3. FIG. 2 is a flow diagram of the system 200 for disabling the movement of the machine 100. More particularly, in this embodiment, the ATRS 120 may be in the raised position. When in the raised position, the ATRS 120 may not come in contact with the cam 206 of the enabler valve 202. Thus, the enabler valve 202 may continue to remain in the closed position. In this case, the actuation module 204 may be disabled and the first, second and third valves 210, 212, 214 may continue to remain in the closed positions respectively.

Additionally, due to the mechanical coupling between the first valve 210 and the third valve 214, when the first valve 210 is in the closed position, the third valve 214 may continue to remain in the locked state. Accordingly, the propulsion module 216 coupled to the actuation module 204 may be deactivated. When an operator attempts to move the machine 100 by issuing the user command to the third valve 214, the third valve 214 may not be actuated and the machine may be prevented from moving. It should be noted that the enabler valve 202 may not be actuated and may remain in the closed position when the ATRS 120 is transitioning from the raised position to the lowered position. Accordingly, the actuation module 204 may remain disabled in this situation.

FIG. 3 is a flow diagram of the system 200 for enabling the movement of the machine 100. In the illustrated embodiment, the ATRS 120 is in the lowered position. In this case, the ATRS 120 may come in contact with the cam 206 of the enabler valve 202 and may actuate the enabler valve 202. Accordingly, the position of the enabler valve 202 may change from the closed position to an open position. Further, the enabler valve 202 may be configured to send the pilot signal 220 to the actuation module 204. Thus, in this case, the actuation module 204 may be enabled when the ATRS 120 is in the lowered position.

More specifically, the enabler valve 202 may send the pilot signal 220 to the second valve 212 of the actuation module 204. Based on the received pilot signal 220, the second valve 212 may be configured to shift to an open position. Further, when in the open position, the second valve 212 may be configured to send the load sense signals 222 to the first valve 210. Based on the received load sense signals 222, the first valve 210 may send trigger signals (not shown) to each of the pumps 208. The trigger signals may cause the pumps 208 to operate at full capacity. Accordingly, the pumps 208 may be configured to send high pressure signals 302 to the first valve 210. Also, the first valve 210 may shift to an open position based on the received load sense signals 222. The third valve 214 may also shift to an unlocked state based on the opening of the first valve 210. In this case, the operator of the machine 100 may be able to freely operate the third valve 214. Further, when the user command is issued to the third valve 214, the high pressure signals 302 may be sent to the propulsion module 216, allowing the machine 100 to move.

INDUSTRIAL APPLICABILITY

The operator may attempt to move or propel the roof bolter when the ATRS is in the raised position. Current systems do not prevent the movement of the roof bolter in such situations. When the ATRS is in the raised position, the movement of the roof bolter may cause catastrophic damage to the mine and/or the roof bolter. Generally, the operator may need to manually check if the ATRS is raised before moving the roof bolter. This process requires added reliance on the operator before moving the roof bolter.

Figure 4:
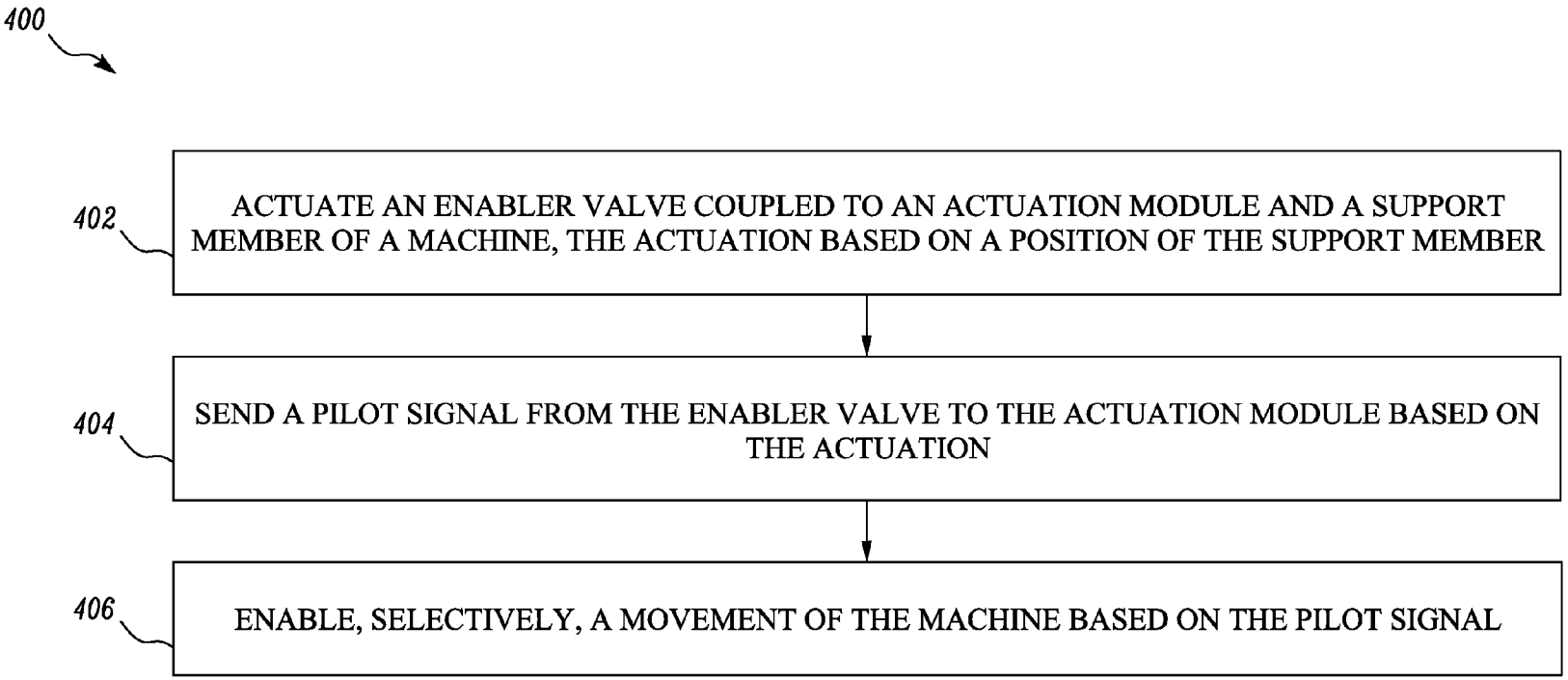
FIG. 4 is a flowchart of a method for enabling the movement of the machine.

The present disclosure relates to the system 200 for enabling the movement of the machine 100 based on the position of the ATRS 120 with respect to the machine 100. FIG. 4 illustrates a method 400 for enabling the movement of the machine 100 based on the position of the ATRS 120.

As described earlier, initially, the pumps 208 may send the pressure signals 218 to the first valve 210 and load sense signals 222 to the second valve 212. Further, the first valve 212 may send the pilot signal 220 to the enabler valve 202. At step 402, the enabler valve 202 coupled to the actuation module 204 and the ATRS 120 may be actuated based on the position of the ATRS 120. More particularly, when the ATRS 120 is in the lowered position the enabler valve 202 may be actuated.

At step 404, based on the actuation of the enabler valve 202, the enabler valve 202 may send the pilot signal 220 to the second valve 212 of the actuation module 204. On receiving the pilot signal 220 from the enabler valve 202, the second valve 212 may be actuated. At step 406, the movement of the machine 100 may be enabled based on the pilot signal 220. More particularly, based on the actuation of the second valve 212, the second valve 212 may send the load sense signals 222 to the first valve 210. On receiving the load sense signals 222, the first valve 210 may be actuated. Accordingly, the first valve 210 may send the high pressure signals 302 to the third valve 214.

Additionally, based on the actuation of the first valve 210, the third valve 214 may change from the locked state to the unlocked state. This may allow or enable the machine 100 to be moved when the user command may be issued. When the user command is issued, the third valve 214 may be operated, causing the high pressure signals 302 to be sent to the propulsion module 216. The propulsion module 216 may be coupled to ground engaging members 106 to move or propel the machine 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for selectively enabling and disabling movement of a machine relative to a surface on which the machine is supported, the system comprising:

a mobile machine supported on a surface, the mobile machine including a machine frame and a support member coupled to and moveable relative to the machine frame between a first position and a second position different from the first position;

an actuation module configured to enable movement of the machine along the surface based on the support member being in the first position, and configured to disable movement of the machine along the surface based on the support member being in the second position; and an enabler valve coupled to the actuation module and the support member, the enabler valve configured to send a pilot signal to the actuation module based on the support member being in the first position to enable movement of the machine along the surface.

2. The system of claim 1, wherein the actuation module includes:

a pump;

a first valve coupled to the enabler valve and the pump, the first valve configured to send the pilot signal to the enabler valve; and a second valve coupled to the enabler valve, the first valve and the pump, the second valve configured to:

receive the pilot signal from the enabler valve based on the support member being in the first position; and actuate the first valve based on the received pilot signal.

3. The system of claim 2, wherein the actuation module further comprises:

a third valve mechanically coupled to the first valve, the third valve configured to enable movement of the machine along the surface based on both actuation of the first valve and a user command when the support member is in the first position.

4. The system of claim 3, wherein the third valve is configured to be in a locked state and a closed position disabling operation of the third valve even on receiving a user command when the support member is in the second position.

5. The system of claim 1, wherein the support member is configured to support the roof of a mine when the support member is in the second position.

6. The system of claim 1, further including a cam coupled to the enabler valve and configured to actuate the enabler valve based on the support member being in the first position.

7. The system of claim 6, wherein the first position is a lowered position of the support member with respect to the machine frame, and the second position is a raised position of the support member with respect to the machine frame, and wherein the cam is configured to selectively actuate the enabler valve when the support member is in the lowered position.

8. A method for selectively enabling and disabling movement of a mobile machine relative to a surface on which the machine is supported, the machine including a machine frame and a support member coupled to and moveable relative to the machine frame between a first position and a second position different from the first position, the method comprising:

based on the support member being in the first position:

actuating an enabler valve coupled to an actuation module;

sending a pilot signal from the enabler valve to the actuation module based on the actuation of the enabler valve; and enabling movement of the machine relative to the surface on which the machine is supported based on the pilot signal; and based on the support member being in the second position:

disabling movement of the machine relative to the surface on which the machine is supported.

9. The method of claim 8, including sending the pilot signal from a first valve to the enabler valve before sending the pilot signal from the enabler valve to the actuation module, and sending a load sense signal from a pump to a second valve.

10. The method of claim 9, further including:

actuating the second valve based on the actuation of the enabler valve;

sending the load sense signal from the second valve to the first valve based on actuating the second valve;

actuating the first valve based on the load sense signal; and receiving a pressure signal from the pump based on actuation of the first valve.

11. The method of claim 10, further including:

actuating a third valve based on actuation of the first valve; and moving the machine relative to the surface on which it is supported based on both actuation of the third valve and a user command.

12. The method of claim 11, further including maintaining the third valve in a locked state and a closed position and disabling operation of the third valve even on receiving a user command when the support member is in the second position.

13. A machine comprising:

a power source;

a machine frame;

a ground engaging member supporting the machine frame for movement along a surface;

a support member coupled to and moveable relative to the machine frame between a first position and a second position different from the first position;

an actuation module configured to enable movement of the machine frame along the surface based on the support member being in the first position and configured to disable movement of the machine frame along the surface based on the support member being in the second position;

an enabler valve coupled to the actuation module and configured to send a pilot signal to enable the actuation module based on the support member being in the first position; and a propulsion module coupled to the actuation module and the ground engaging member, the propulsion module configured to move the machine frame along the surface based on both the actuation module being enabled and a user command.

14. The machine of claim 13, wherein the actuation module includes:

a pump;

a first valve coupled to the enabler valve and the pump, the first valve configured to send the pilot signal to the enabler valve; and a second valve coupled to the enabler valve, the first valve and the pump, the second valve configured to:

receive the pilot signal from the enabler valve based on the support member being in the first position; and actuate the first valve based on the received pilot signal.

15. The machine of claim 14, wherein the actuation module further includes:

a third valve mechanically coupled to the first valve, the third valve configured to enable movement of the machine along the surface based on both actuation of the first valve and a user command when the support member is in the first position.

16. The machine of claim 15, wherein the third valve is configured to be in a locked state and a closed position disabling operation of the third valve even on receiving a user command when the support member is in the second position.

17. The machine of claim 13, wherein the support member is configured to support the roof of a mine when the support member is in the second position.

18. The machine of claim 13, further including a earn coupled to the enabler valve and configured to actuate the enabler valve based on the support member being in the first position.

19. The machine of claim 18, wherein the first position is a lowered position of the support member with respect to the machine frame, and the second position is a raised position of the support member with respect to the machine frame, and wherein the cam is configured to selectively actuate the enabler valve when the support member is in the lowered position.

20. The machine of claim 13, wherein the machine comprises a roof bolter, and the support member is configured to support the roof of a mine when the support member is in the second position.

* * * * *